US007406831B2

(12) United States Patent
Montanari

(10) Patent No.: US 7,406,831 B2
(45) Date of Patent: Aug. 5, 2008

(54) PROCESS FOR THE MAKING OF ICE CUPS

(75) Inventor: Mario Montanari, Bologna (IT)

(73) Assignee: Reale S.r.l., Bologna (IT)

( * ) Notice: Subject to any disclaimer, the term of this patent is extended or adjusted under 35 U.S.C. 154(b) by 286 days.

(21) Appl. No.: 10/531,736

(22) PCT Filed: Oct. 17, 2003

(86) PCT No.: PCT/IB03/04622

§ 371 (c)(1),
(2), (4) Date: Apr. 6, 2006

(87) PCT Pub. No.: WO2004/036126

PCT Pub. Date: Apr. 29, 2004

(65) Prior Publication Data

US 2006/0201169 A1 Sep. 14, 2006

(30) Foreign Application Priority Data

Oct. 17, 2002 (IT) ..... BO2002A0657

(51) Int. Cl.
*F25C 1/12* (2006.01)

(52) U.S. Cl. ..... 62/73; 62/74; 62/75; 62/347

(58) Field of Classification Search ..... 62/73–75, 62/347, 352

See application file for complete search history.

(56) References Cited

U.S. PATENT DOCUMENTS

| | | | | | |
|---|---|---|---|---|---|
| 2,949,019 | A | * | 8/1960 | Roberts | 62/347 |
| 3,791,163 | A | * | 2/1974 | Dickson et al. | 62/347 |
| 3,908,390 | A | | 9/1975 | Dickson et al. | |
| 4,942,742 | A | * | 7/1990 | Burruel | 62/347 |
| 4,966,015 | A | * | 10/1990 | Wessa | 62/347 |
| 5,265,439 | A | | 11/1993 | Hobelsberger | |
| 6,062,036 | A | * | 5/2000 | Hobelsberger | 62/347 |
| 6,082,121 | A | * | 7/2000 | Marsh et al. | 62/75 |
| 6,557,351 | B1 | * | 5/2003 | Ghedini et al. | 62/1 |

FOREIGN PATENT DOCUMENTS

WO WO 00/00066 1/2000

* cited by examiner

*Primary Examiner*—William E Tapolcai
(74) *Attorney, Agent, or Firm*—Sughrue Mion, PLLC

(57) ABSTRACT

A process for the manufacture of the ice cups in which a condensation plate able to receive water spray for the formation of the ice elements is cooled for a predetermined period of time such as to cause freezing of the water and the subsequent formation of ice elements. When cooling is interrupted the plate is heated for a predetermined interval of time to permit detachment of the ice elements. Between the interruption of cooling and the start of heating the plate is subjected to a plurality of heating stages of increasing duration alternating with a plurality of cooling stage of decreasing duration.

8 Claims, 2 Drawing Sheets

PROCESS FOR THE MAKING OF ICE CUPS

This is a National Stage entry of International Application PCT/IB2003/004622, with an international filing date of Oct. 17, 2003, which was published as WO 2004/036126 A1, and the complete disclosure of which is incorporated into this application by reference.

BACKGROUND OF THE INVENTION

This invention relates to the sector of systems for the manufacture of ice. The invention has been developed with particular reference to an improved process for the manufacture of ice cups.

In order to have a large quantity of ice cups, in particular but not exclusively for use in places which are highly frequented by the public, it may be appropriate to use an automatic machine for the manufacture of ice instead of relying on the manufacture of ice cups in small batches through known systems using a die and mould.

Machines for the manufacture of ice are generally known and will not therefore be discussed in detail. Normally such machines comprise a condensation plate on which there is a plurality of depressions, normally of metal, and more particularly of nickel-plated copper, against which jets of water are delivered via ejectors located beneath the plates. The plate is cooled to a temperature such as to cause the water to freeze and to form cubes or blocks of ice within the depressions. When the temperature of the plate is raised above the freezing temperature, the blocks of ice become detached from the depressions in the plate and fall into a collecting bin ready for use.

In general small ice blocks of the known type have the physical characteristics of especial solidity and resistance to thermal shocks, as a result of which the stages of reversing the temperature of the freezing plate can be carried out suddenly without thereby risking compromising the intact nature of the blocks.

In the case of the manufacture of ice cups, the shape of these ice elements includes the presence of thin ice walls forming the walls of the cup. In this case excessively rapid reversal of the plate temperature could cause thermal shock and consequent damage to the ice layer or even its fracture.

The applicant has carried out many experiments in the sector in question with a view to developing a system for the production of ice cups which would be effective and productive. In this respect the applicant lodged a patent application for an industrial invention BO98A000395 on the 28 Jun. 1998 in which among other things a process for the manufacture of ice cups is illustrated.

The process described by the applicant comprised the stages of cooling the condensation plate, directing a flow of water spray towards the condensation plate for a predetermined period of time sufficient for the formation of ice elements, interrupting cooling of the condensation plate, interrupting the flow of water spray and heating the condensation plate to detach the ice elements. The applicant found that for the optimum manufacture of ice cups it was preferable that an intermediate waiting stage of a predetermined length, lasting for example approximately thirty minutes, should be inserted between interrupting cooling and starting to heat the condensation plate.

Many experiments and investigations which the applicant has continued to carry out subsequently to the date on which the aforesaid patent application was lodged have however demonstrated that this procedure can be further improved in such a way as to achieve further advantages and overcome some technical problems which arose during the aforesaid experiments.

SUMMARY OF THE INVENTION

The object of this invention is to overcome the problems of the known art, and in particular to provide an improved process for the manufacture of ice cups so as to obtain ice elements having very thin surfaces in quick time.

Another object of this invention is to provide a process for the manufacture of ice cups which is easy to carry out and highly reliable.

In order to accomplish the above mentioned objects this invention relates to a process for the manufacture of ice cups of the type indicated in the preamble to this invention and as defined in the claims which follow.

BRIEF DESCRIPTION OF THE DRAWINGS

Other advantages and characteristics of the present invention will become clear from the following detailed description which is given with reference to the appended drawings which are provided purely by way of non-limiting example and in which.

DETAILED DESCRIPTION OF THE INVENTION

Figure 1:
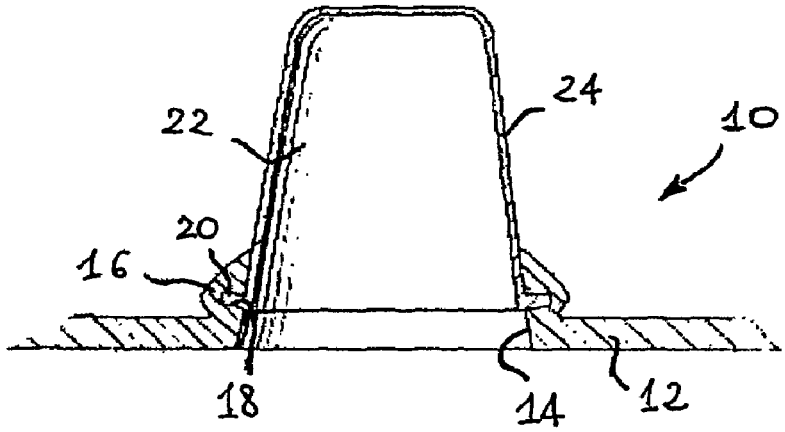
FIG. 1 is a diagrammatical view in lateral cross-section of a condensation plate of a machine for the manufacture of ice.

As illustrated in FIG. 1, a condensation plate 10 of a machine for the manufacture of ice comprises a base 12, preferably but not restrictively of plastics material, for example ABS, located horizontally and provided with circular openings 14 with a profiled edge 16, in which there is a peripheral notch 18 into which is engaged a collar 20 of a cup-shaped vessel 22 having a substantially tapering side wall 24. The maximum inside diameter of side wall 24 is slightly less than the diameter of circular opening 14, so as to encourage detachment of a tapering ice cup after formation within cup-shaped vessel 22 as a result of the freezing of water delivered by ejectors located beneath the same. The taper of side walls 24 of cup-shaped vessel 22 is such that water delivered by the ejector freezes gradually, following the shape of the side wall itself, leaving a central cavity which when the finished ice cup is used is intended to contain a liquid product which is to be drunk or sipped.

The machine for the manufacture of ice also comprises control means, for example, but not restricted thereto, a microprocessor capable when in use of controlling the cooling and heating stages of the condensation plate. The machine also comprises sensor means, preferably a thermal sensor, to measure the temperature of the condensation plate during the process for the manufacture of ice cups.

Figure 2:
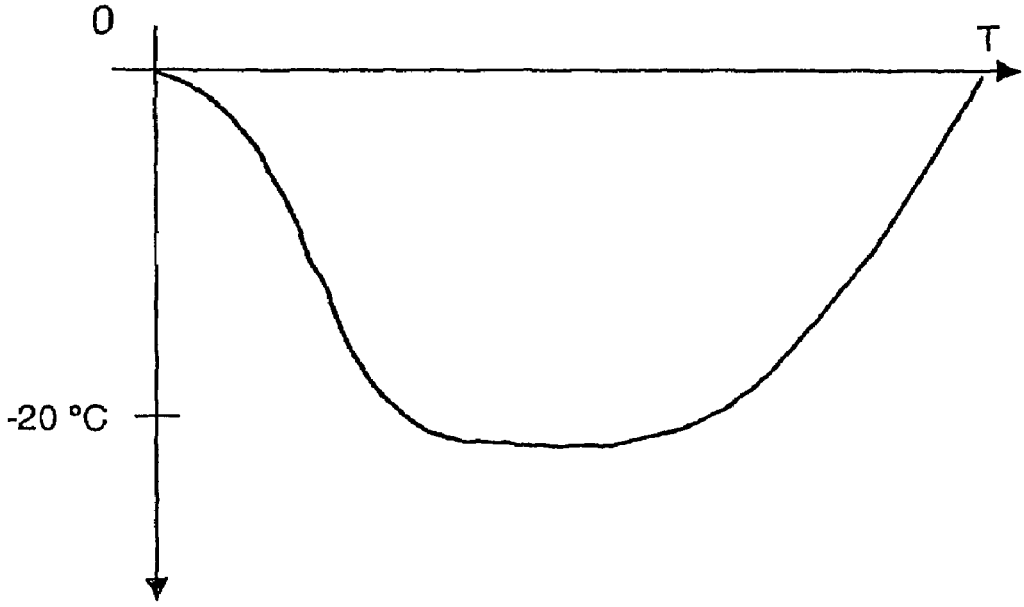
FIG. 2 is a schematic diagram of the temperature of the condensation plate in relation to the duration of the improved process according to this invention.
Figure 3:
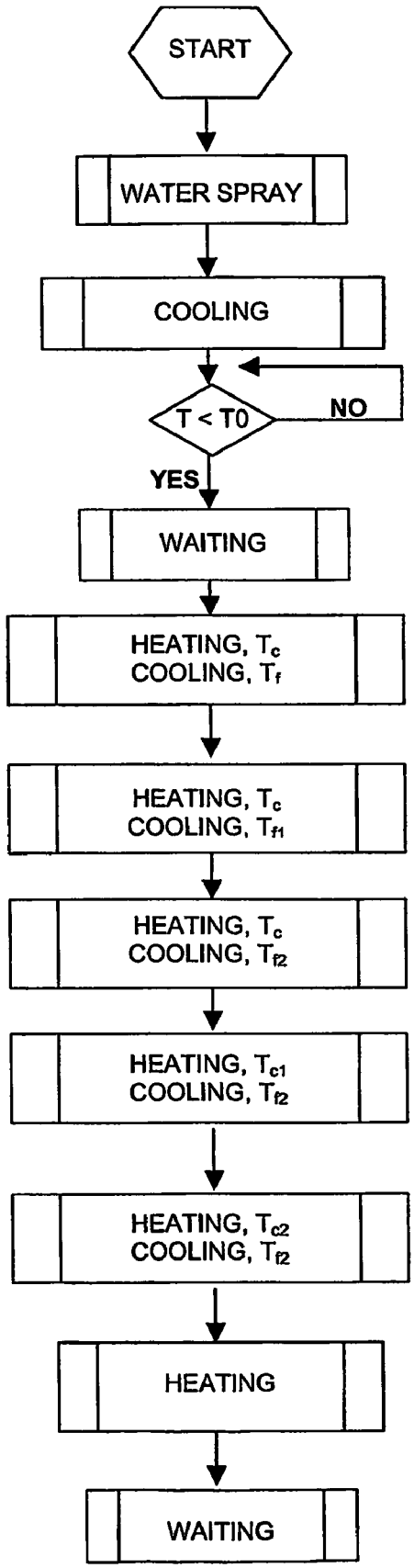
FIG. 3 is a block diagram of an embodiment of the improved process according to this invention.

With reference now to FIGS. 2 and 3, in order to manufacture ice cups according to the improved process according to this invention it is necessary to cool condensation plate 10 to a predetermined temperature, for example, but not restricted thereto, approximately −10° C., preferably around −20° C. At the same time a flow of water spray is directed towards the condensation plate in such a way that with the lowering of temperature it is possible to bring about freezing of the water and permit the formation of ice elements. When the aforesaid temperature is reached, the sensor means send a signal to the control means which interrupt cooling of condensation plate 10. Once the cooling stage has been interrupted, a waiting stage during which the condensation plate is held at a substantially constant temperature for a first predetermined interval of time $T_0$, for example, but not restricted thereto, ten-fifteen seconds. During this waiting stage the flow of water spray is also held constant.

After the waiting stage the condensation plate is subjected to a plurality of heating stages of increasing duration alternating with corresponding cooling stages of decreasing duration.

In particular, once the first predetermined time interval $T_0$ has passed, the condensation plate is heated for a predetermined time interval $T_c$ during which the temperature of the plate is partly raised. After this interval $T_c$ the condensation plate is cooled for another interval of time $T_f$ which is longer than time interval $T_c$, for example, but not restricted thereto, twice the same, causing the rise in the temperature of the plate to slow.

After interval of time $T_f$ the plate is heated for a further interval of time $T_c$, after which the plate is cooled for a predetermined interval of time $T_{f1}$ which is shorter than $T_f$.

After time interval $T_{f1}$, the two subsequent stages of heating and cooling are activated and both are maintained for the same intervals of time equal to, for example, but not restricted thereto, $T_c$.

Subsequently the heating stage is activated for an interval of time $T_{c1}$ which is longer than interval of time $T_{f2}$ for the subsequent cooling stage. Finally a stage is reached in which the heating is activated for an interval of time $T_{c2}$ which is very much greater than the heating interval of time $T_{f2}$, for example, but not restricted thereto, twice the same.

To sum up, the lengths of the intervals of time for the cooling and heating stages of the condensation plate can be summarised as follows:

$$T_c<T_{c1}<T_{c2};\ T_f>T_{f1}>T_{f2}.$$

According to a preferred embodiment of this invention, intervals of time $T_c$ and $T_{f2}$ are the same, as are $T_{c2}$ and $T_f$. In accordance with a further particularly advantageous embodiment each heating stage of increasing length and the subsequent cooling stage of decreasing length have overall a duration of for example, but not restricted thereto, approximately 30 seconds.

Of course the number and the sequence of cooling and heating stages, and the durations of the intervals described hitherto, can easily be varied by a person skilled in the art without thereby going beyond the scope of this invention.

Once this sequence of heating and cooling stages is complete, the condensation plate is finally heated for a further predetermined interval of time, for example, but not restricted thereto, 30 seconds, in such a way that the increase in the temperature of the plate is such as to permit the ice elements to detach. Once the ice elements have become detached, the machine for the manufacture of ice is switched off for a further predetermined interval of time.

The flow of water spray directed towards the condensation plate may be maintained throughout all the stages of the process described above and interrupted during detachment of the ice elements, or also continued during this stage to further assist detachment of the ice elements.

As illustrated in FIG. 2, the curve described by the temperature throughout the procedure is "softer" than the temperature curves described by devices of the known type. This behaviour denotes a slow progressive change in the temperature of the condensation plate which prevents any thermal shock phenomena and encourages faster and more effective formation of the ice cups.

One of the main advantages of this invention comprises the possibility of controlling the temperature of the condensation plate at all stages in the process. It is possible in fact to programme each individual stage in the process, predetermining the sequence, the duration and the number of intervals of time during which the condensation plate is cooled and heated. On the basis of the duration of the cooling time, and the number and duration of the heating intervals, it is possible to control the characteristics and the shapes of the ice elements, such as for example the thickness of the ice cup walls and, consequently, the duration of the entire process.

Naturally, the principle of the invention remaining the same, the forms of embodiment and details of construction may be varied widely with respect to those described and illustrated, which have been given purely by way of example, without thereby departing from the scope of the invention.

What is claimed is:

1. Process for the manufacture of ice elements using a machine for the manufacture of ice of the type comprising a condensation plate capable of receiving water spray for the formation of ice elements, comprising the stages of:

a) directing a flow of water spray towards the condensation plate and cooling the condensation plate, b) cooling the condensation plate for a predetermined period of time such as to cause freezing of the water and the consequent formation of ice elements, c) interrupting the cooling of the condensation plate, d) heating the condensation plate for an interval of time of predetermined duration so as to permit detachment of the ice elements, characterised in that the following stages are inserted in combination with each other between stage c) and stage d):

e) heating the condensation plate through one or more heating stages of increasing duration, f) cooling the condensation plate through one or more cooling stages of decreasing duration.

2. Process according to claim 1, characterised in that the heating stages of increasing duration alternate with subsequent cooling stages of decreasing duration.

3. Process according to claim 2, characterised in that an intermediate waiting stage of predetermined length is inserted between the interruption of cooling and the first stage in which the condensation plate is heated.

4. Process according to claim 3, characterised in that the intermediate waiting stage has a duration of approximately 10-15 seconds.

5. Process according to claim 2, characterised in that each heating stage of increasing duration and the subsequent cooling stage of decreasing duration has overall a length of approximately 30 seconds.

6. Process according to claim 1, characterised in that the flow of water spray directed towards the condensation plate is maintained until the ice elements detach.

7. Process according to claim 1, characterised in that once the ice elements have detached the machine for the manufacture of ice is switched off for a predetermined interval of time.

8. Process according to claim 1, characterised in that during stage a) the condensation plate is cooled to a temperature of approximately −20° C.

* * * * *